US009055818B2

(12) United States Patent
Ludeke et al.

(10) Patent No.: US 9,055,818 B2
(45) Date of Patent: Jun. 16, 2015

(54) UNSUPPORTED COVERING FOR SEATING AND RECLINING FURNITURE

(75) Inventors: Christine Ludeke, Zurich (CH); Christina Ziltener, Zurich (CH); Franz Stollberger, St. Martin (AT)

(73) Assignees: Kobleder Strickmode GmbH & Co., St. Martin im Innkreis (CH); Ludeke Design, Zurich (CH)

( * ) Notice: Subject to any disclaimer, the term of this patent is extended or adjusted under 35 U.S.C. 154(b) by 1981 days.

(21) Appl. No.: 12/295,700

(22) PCT Filed: Apr. 3, 2007

(86) PCT No.: PCT/EP2007/002974

§ 371 (c)(1),
(2), (4) Date: Nov. 4, 2010

(87) PCT Pub. No.: WO2007/115735

PCT Pub. Date: Oct. 18, 2007

(65) Prior Publication Data

US 2011/0043011 A1 Feb. 24, 2011

(30) Foreign Application Priority Data

Apr. 3, 2006 (DE) ..... 10 2006 015 801
Jun. 21, 2006 (DE) ..... 10 2006 028 444

(51) Int. Cl.
*A47C 5/06* (2006.01)
*A47C 7/02* (2006.01)

(52) U.S. Cl.
CPC ..... *A47C 5/06* (2013.01)

(58) Field of Classification Search
USPC ..... 297/452.56, 452.64, 452.13, 440.11
See application file for complete search history.

(56) References Cited

U.S. PATENT DOCUMENTS

| | | | | |
|---|---|---|---|---|
| 2,209,145 | A * | 7/1940 | Weber | 297/1 |
| 2,684,709 | A | 7/1954 | Schawinsky | |
| 4,837,878 | A * | 6/1989 | Huemer | 5/191 |
| 4,894,877 | A * | 1/1990 | Marsh | 5/618 |
| 5,013,089 | A * | 5/1991 | Abu-Isa et al. | 297/452.64 |
| 5,167,264 | A | 12/1992 | Kaelin | |
| 5,247,893 | A * | 9/1993 | Zafiroglu | 112/475.08 |
| 5,632,526 | A * | 5/1997 | McLarty et al. | 297/452.64 |
| 6,035,901 | A * | 3/2000 | Stumpf et al. | 139/419 |
| 6,494,540 | B1 * | 12/2002 | Tornero | 297/440.1 |
| 6,702,389 | B2 * | 3/2004 | Hall et al. | 297/452.56 |
| 6,886,890 | B2 * | 5/2005 | Rowland et al. | 297/452.56 |
| 6,988,774 | B1 | 1/2006 | Elzenbeck | |
| 2002/0063455 | A1 | 5/2002 | Self | |
| 2004/0160109 | A1 | 8/2004 | Bottemiller | |
| 2006/0207296 | A1 * | 9/2006 | Fujikawa | 66/202 |

FOREIGN PATENT DOCUMENTS

| | | |
|---|---|---|
| EP | 1 680 981 | 7/2006 |
| JP | 88210/1973 | 10/1973 |
| JP | 2608/1974 | 1/1974 |
| JP | 2002-238689 | 8/2002 |
| JP | 2004-33542 | 2/2004 |
| JP | 2004-254769 | 9/2004 |
| WO | 99/43239 | 9/1999 |

* cited by examiner

*Primary Examiner* — David R Dunn
*Assistant Examiner* — Tania Abraham
(74) *Attorney, Agent, or Firm* — Michael J. Striker

(57) ABSTRACT

A covering (3) for seating or reclining furniture (1), which is composed of a knit and aligned essentially in parallel with the mounting direction in a mounted condition transversely to a mounting direction, is elastically deformable, at least in one area, when under load transversely to the mounting direction. Accordingly it is suitable for adapting well to a body shape of a user.

17 Claims, 2 Drawing Sheets

UNSUPPORTED COVERING FOR SEATING AND RECLINING FURNITURE

The invention relates to a covering for seating or reclining furniture as well as to seating or reclining furniture comprising a covering.

Coverings for seating or reclining furniture are preformed and therefore suitable for receiving and supporting the body of a user in an efficient manner. When unused such seating or reclining furniture appears unaesthetic.

It is the requirement of the invention to provide a covering which makes it possible to create seating or reclining furniture having an innovative shaping.

According to the invention this requirement is met by a covering for seating or reclining furniture which is composed of a knitted fabric, and which in a no-load condition transversely to the mounting direction is essentially aligned in parallel with the mounting direction, and when under load transversely to the mounting direction is elastically deformable, at least in one area. Accordingly the covering is a knitted fabric which, in particular, is unsupported when mounted on or to a frame and in a no-load condition represents a surface extending essentially parallel to a mounting direction. In a no-load condition transversely to the mounting direction the knitted fabric is thus not preformed. This opens the way for new design possibilities for seating or reclining furniture. The knitted fabric may be a one-colour knit produced in various known knitting patterns or using inlay and/or jacquard techniques. The covering adapts particularly well to the body shape of a user giving him optimum support.

It is particularly advantageous if the cover is stretchable up to a specified limit, at least in one area, and remains stable under further load. Initially therefore the covering adapts to the body shape of a user and supports him when a specified limit is reached.

In a particularly preferred embodiment there may be areas of different elasticity. In areas corresponding to different body parts the covering needs to vary in flexibility in order to feel comfortable and needs to have different supporting properties. This can be accommodated by providing different elasticities.

Areas of different elasticity may be created in a particularly simple manner if the areas of different elasticity have different amounts of stitches per knitting row.

The comfort of the covering for a user may be increased if a back area is of greater elasticity than a seat area. In order to increase elasticity in the back area extra stitches per knitting row may be provided.

The thigh area of a user needs to be particularly well supported and therefore, the corresponding area of the covering should be of low elasticity. Thus it is advantageous if a seat area and/or a lower back area has more stitches per knitting row than a support area for the thighs.

Therefore the knitted fabric forming the covering is preferably designed in such a way as to allow the knitted fabric in the intended seat area to be stretched up to a certain limit due to the load and thereafter to remain stable. The back area is preferably knitted in such a way as to be particularly elastic with extra stitches inserted into it to allow the back to spring back appropriately in a rearward direction. In the supporting area for the thighs on the other hand, the knitted fabric should have little elasticity. In the area of the seat and lower back the knitted fabric may also have more stitches per knitting row than in the thigh-supporting area. This can be achieved through the use of "Spickel" techniques. Or the elasticity in the various areas may be varied through yarn selection, type of weave, the inclusion of pile threads or similar.

Secure attaching and fixing of the covering to the frame is advantageously achieved by providing fastening means, in particular clamping mechanisms (Keder) on the covering. The clamping mechanisms may, for example, be fastened to a profile frame.

An alternative attachment solution results if the covering is formed in the shape of a sack. This allows the covering to be drawn back over a frame. This eliminates the need for any further fastening means. A sack-shaped covering may then be knitted in one piece, for example without the necessity for any further seams.

Further advantages are revealed if the covering is manufactured as a two-layer fabric, at least in parts. The seat and/or the back area, in particular, could be a two-layer construction. This helps to increase comfort.

The sitting and reclining comfort in particular can be increased if the space between two layers is filled with padding. Suitable materials for padding would, for example, be foam materials, fleeces, air cushions or spacer fabrics.

To increase the sitting comfort it is particularly advantageous if a spacer fabric is provided in the seat area.

Manufacturing is particularly quick and low-waste if the covering is produced in one piece. In particular seams can be avoided thereby.

The covering is particularly wear-resistant if it is knitted from synthetic yarns, especially polyester yarns or polyamide yarns. Other materials can, however, also be used.

In one embodiment the covering may be knitted from monofilament yarns and/or multifilament yarns. Yarn selection is one way of influencing the properties of the covering, especially its elasticity. Multifilament yarns in particular can have elastic properties.

Elasticity is not only achieved by varying the amount of stitches per knitting row, but also by using elastic yarns in producing the knit.

The scope of the invention also covers seating or reclining furniture with a frame on which a covering as described above is disposed. This type of seating or reclining furniture may have an innovative shape, in particular in unused condition.

Advantageously the frame comprises at least two legs on opposite sides. These legs may be used for fastening the covering and mounting it in parallel with a mounting direction. A mounting surface is therefore defined by the two opposing legs of the frame. The legs may be shaped straight or curved. When the legs are straight the mounting surface is a mounting plane. The frame may, however, also have more than two legs, for example three or four legs.

In a particularly advantageous embodiment the frame may be open, at least on one side. Depending upon how the covering is fastened this may have advantages. For example, the covering may be threaded onto the frame open on at least one side.

Especially when the seating or reclining furniture shall be used as a deck chair, it is advantageous, if the area of the frame defining a mounting surface has an incline of about 60° to the horizontal. This makes it possible for a user under whose weight the covering shapes itself into a kind of seating shell to feel particularly relaxed in a sitting or reclining position.

Further advantages result if the area of the frame defining a mounting surface can be adjusted with regard to the incline. This allows individual adjustment of the seating or reclining furniture.

Further features and advantages of the invention are revealed in the following detailed description of the embodiments of the invention with reference to the figures of the drawing which shows details essential to the invention, as well as in the claims. Individual features may be realised singly on their own or severally in random combinations in variants of the invention.

The schematic drawing shows embodiments of the invention which will be explained in detail in the description below.

In the figures

Figure 1:
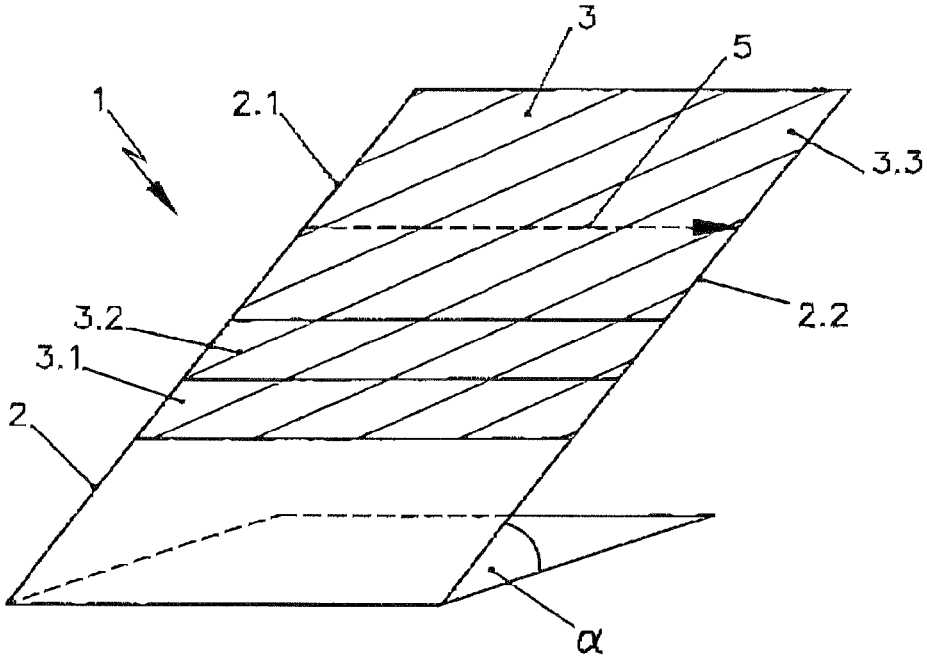
FIG. 1 shows a perspective view of a piece of seating or reclining furniture in unused condition.

FIG. 1 shows a piece of seating or reclining furniture 1 which comprises a frame 2 carrying a covering 3. The covering 3 is composed of a knitted fabric representing a level surface when in unused condition as shown. The legs 2.1, 2.2 of the frame arranged on opposing sides define a mounting surface, whereby the mounting direction is indicated by arrow 5. In the condition illustrated the covering 3 is load-free in the direction extending transversely to the mounting direction and thus is aligned in parallel with the mounting direction. It is therefore located in or parallel to the mounting surface. That part of the frame 2 which carries the covering 3 has an angle $\alpha$ to the horizontal which is preferably 60°.

In the embodiment the covering 3 comprises areas 3.1, 3.2, 3.3 of varying elasticity, whereby area 3.1 is provided for supporting the thighs, area 3.2 for receiving the seat and area 3.3 for receiving the back area of a user. The sectioning of the covering 3 is merely shown schematically. It will be understood that further areas and areas whose shapes deviate from purely rectangular shapes may also be defined.

Figure 2:
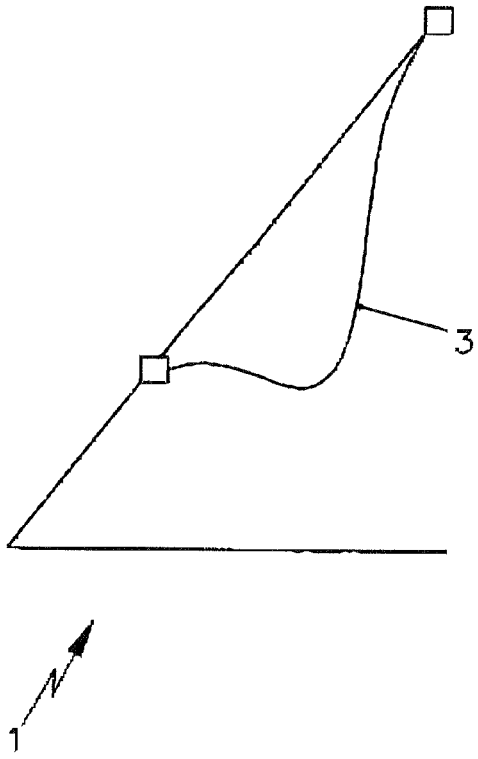
FIG. 2 shows a sectional view of the piece of seating or reclining furniture in used condition.

In the sectional view illustrated in FIG. 2 the covering 3 has been shaped by a user (not shown) who has sat down on the piece of seating or reclining furniture 1. This means that the covering 3 has been subjected to a load transversely to the mounting direction or mounting surface. The covering 3 is therefore configured so as to be flexible and yielding under the weight of a user up to a specified limit. Thereafter the covering 3 does not yield any further and supports the body of a user. In the absence of any load on the covering 3 transversely to the mounting direction the covering 3 essentially returns to its original position shown in FIG. 1, due its elastic properties.

The invention claimed is:

1. A covering for seating or reclining furniture formed with a frame with opposing first and second legs, the covering comprising:

a knitted fabric having areas of different elasticity based on different amounts of stitching per knitted row therein and, configured for fixation to the first and second legs of the frame;

wherein fixing the knitted fabric to the first and second legs, under a no-load condition, defines a covering surface that is substantially planar and that has a mounting direction extending between the first and second legs; and wherein under a load imposed on the planar covering surface transversely to the mounting direction, the covering is elastically deformable, at least in one area.

2. The covering according to claim 1, wherein the covering is stretchable up to a specified limit, at least in one area and remains stable under further load.

3. The covering according to claim 1, wherein a back area has a greater elasticity than a seat area.

4. The covering according to claim 3, wherein in order to increase the elasticity in the back area, additional stitches per knitting row are provided.

5. The covering according to claim 1, wherein a seat area and/or a lower back area has more stitches per knitting row than a thigh supporting area.

6. The covering according to claim 1, wherein the covering has fastening means.

7. The covering according to claim 1, wherein the covering is manufactured as a two-layer fabric, at least in parts.

8. The covering according to claim 1, wherein a spacer fabric for increasing comfort is provided.

9. The covering according to claim 1, wherein the covering is manufactured in one piece.

10. The covering according to claim 1, wherein the covering is manufactured without seams.

11. The covering according to claim 1, wherein the covering is knitted from synthetic yarns.

12. The covering according to claim 1, wherein the covering is knitted from monofilament and/or multifilament yarns.

13. The covering according to claim 1, wherein the knit comprises elastic yarns.

14. A seating or reclining furniture with a frame on which a covering is provided, the covering comprising:

a knitted fabric having areas of different elasticity based on different amounts of stitching per knitted row therein and, configured for fixation to the first and second legs of the frame;

wherein fixing the knitted fabric to the first and second legs, under a no-load condition, defines a covering surface that is substantially planar and that has a mounting direction extending between the first and second legs; and wherein under a load imposed on the planar covering surface transversely to the mounting direction, the covering is elastically deformable, at least in one area.

15. The seating or reclining furniture according to claim 14, wherein the frame is open on at least one side.

16. The seating or reclining furniture according to claim 14, wherein an area of the frame defining the mounting surface has an incline of approximately 60°.

17. The seating or reclining furniture according to claim 14, wherein the area of the frame defining a mounting surface is adjustable in respect of the incline.

* * * * *